US009439498B1

(12) United States Patent
Eversley et al.

(10) Patent No.: US 9,439,498 B1
(45) Date of Patent: Sep. 13, 2016

(54) DEVICE FOR APPLYING LIP COATING AND METHOD OF USE

(71) Applicants: Naomi Grizelda Eversley, Charlotte, NC (US); Diamond Tantrel Majett, Charlotte, NC (US)

(72) Inventors: Naomi Grizelda Eversley, Charlotte, NC (US); Diamond Tantrel Majett, Charlotte, NC (US)

( * ) Notice: Subject to any disclaimer, the term of this patent is extended or adjusted under 35 U.S.C. 154(b) by 0 days.

(21) Appl. No.: 14/618,013

(22) Filed: Feb. 10, 2015

(51) Int. Cl.
*A45D 40/26* (2006.01)
*A45D 42/02* (2006.01)

(52) U.S. Cl.
CPC ..... *A45D 40/26* (2013.01); *A45D 42/02* (2013.01)

(58) Field of Classification Search
CPC .. A45D 40/26; A45D 40/262; A45D 40/264; A45D 40/28; A45D 40/18; A45D 40/205; A45D 42/02; A45D 34/042; A45D 34/043; A45D 34/045; A45D 34/06; A45D 2040/0025; A45D 2040/201; A45D 2200/10; A45D 2200/1009; A45D 2200/1018; A45D 2200/1036; A45D 2200/1072; A45D 2200/1027; A45D 33/006; A45D 33/008; A45D 33/28; A45D 29/11; A45D 29/18; A46B 2200/1046; A46B 2200/10; A46B 2200/20; A46B 15/0055; A46B 15/0077; A46B 15/0061; A46B 5/0025; A46B 5/0062; A46B 5/0029; A46B 5/0066; A46B 9/005; A46B 9/021; A45B 5/0037; A45C 11/008
USPC ..... 132/320, 200, 73, 75.3, 75, 286, 297, 132/301, 313, 316, 317, 318, 333, 218; 401/89
See application file for complete search history.

(56) References Cited

U.S. PATENT DOCUMENTS

D123,237 S * 10/1940 Schmucker ..... 132/316
2,730,112 A * 1/1956 Cramer ..... A45D 40/18 132/318
2,736,326 A * 2/1956 Cramer ..... A45D 40/18 132/286
2,804,081 A * 8/1957 Rosa ..... A45D 40/18 132/286
3,150,808 A * 9/1964 Vensel ..... A47K 10/3818 221/59
3,432,081 A * 3/1969 Forte ..... A45D 40/28 206/216
3,627,216 A * 12/1971 Ekuan ..... A47K 10/3818 225/39
4,887,994 A * 12/1989 Bedford ..... A61M 35/006 132/317
5,174,310 A * 12/1992 Galbraith ..... A45D 42/02 132/316
5,909,740 A * 6/1999 Sussman ..... A45D 40/20 132/316
6,059,474 A * 5/2000 Huang ..... A45D 29/007 132/73.5
6,065,477 A * 5/2000 Doo ..... A45D 34/04 132/73
6,079,423 A * 6/2000 Suzuki ..... A45D 40/28 132/317

(Continued)
OTHER PUBLICATIONS http://www.personalcreations.com/blog/diaper-cake-how-to How to Make a Diaper Cake for Baby Showers, Mar. 10, 2104.*

*Primary Examiner* — Rachel Steitz
(74) *Attorney, Agent, or Firm* — Ted Masters

(57) ABSTRACT

A device for applying lip coating includes an applicator which has a handle which is connected to an application end by a shaft. The application end is smooth in order to facilitate cleaning. A housing removably receives the shaft and application end when the device is not being used. In an embodiment the application end includes a frustoconical section and a rounded tip. In another embodiment a cleaning device for cleaning the application end is contained with the handle.

1 Claim, 5 Drawing Sheets

(56) References Cited

U.S. PATENT DOCUMENTS 6,227,737 B1 * 5/2001 Lightfoot ..... A45D 40/265 118/264
7,559,504 B2 * 7/2009 Yang ..... A47K 10/3836 242/422.4
7,874,300 B2 * 1/2011 Roeder ..... A45D 40/28 132/218
8,444,338 B2 * 5/2013 Kurek ..... A45D 34/06 401/129
8,726,916 B2 * 5/2014 Park ..... A46B 5/0095 132/313
2003/0194255 A1 * 10/2003 Silberman ..... A45D 34/04 401/18
2005/0150513 A1 * 7/2005 Taylor ..... A45D 42/02 132/316
2012/0037180 A1 * 2/2012 Rossi ..... A45D 40/26 132/320
2012/0180808 A1 * 7/2012 Nakamura ..... A45D 33/006 132/320
2012/0204899 A1 * 8/2012 Uehara ..... A45D 34/045 132/320
2012/0312315 A1 * 12/2012 Gueret ..... A45D 34/045 132/200
2014/0331422 A1 * 11/2014 Lim ..... A45D 40/262 15/106

* cited by examiner 20
22
24
30
32
26
28
25

Fig. 3
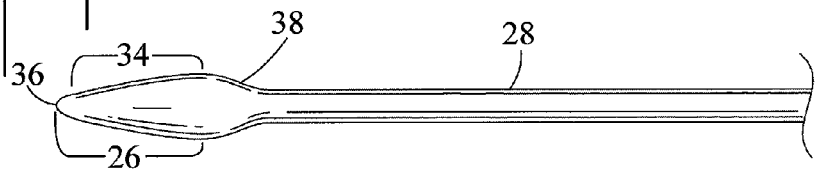
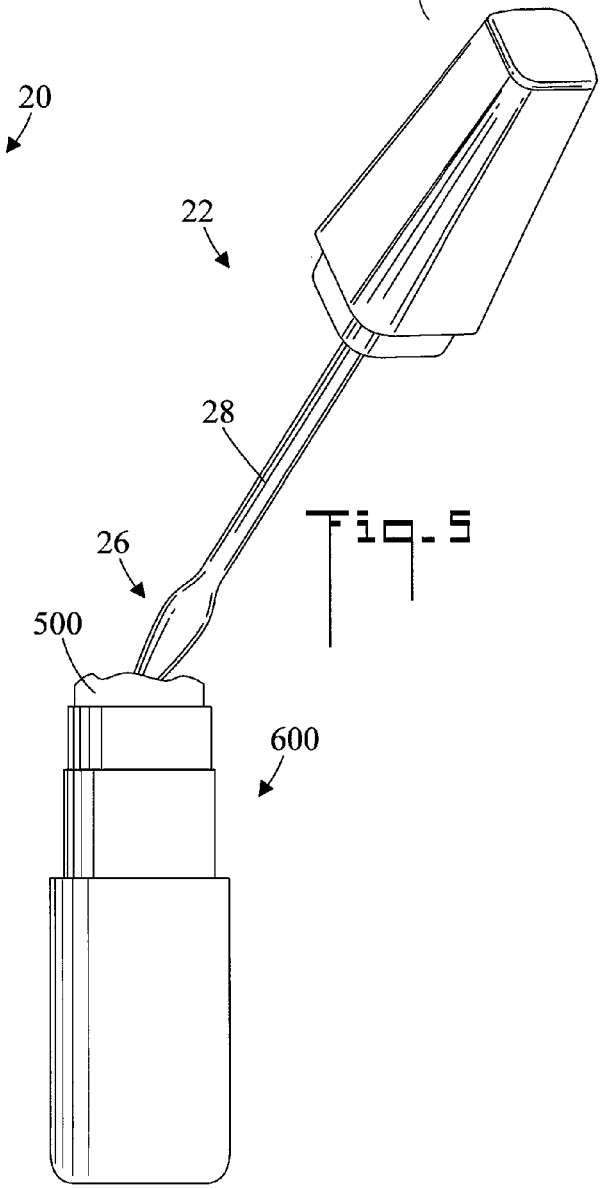
Fig. 4
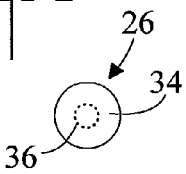
Fig. 5

Fig. 9
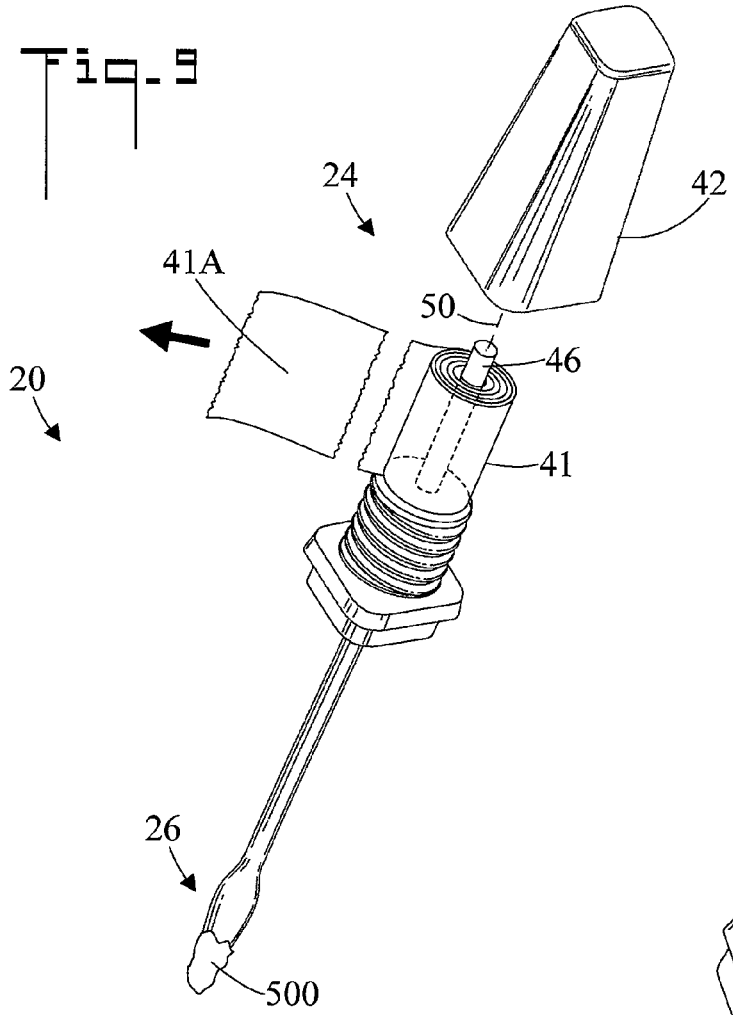
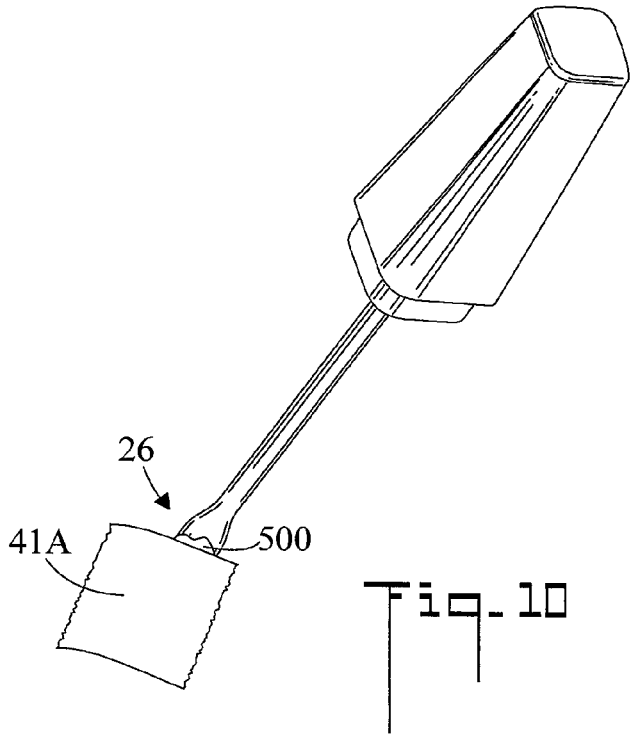
Fig. 10

DEVICE FOR APPLYING LIP COATING AND METHOD OF USE

CROSS REFERENCE TO RELATED APPLICATION

None

TECHNICAL FIELD

The present invention pertains generally to lip coatings, and more particularly to a device and method for applying the lip coating.

BACKGROUND OF THE INVENTION

Lip coatings are well known in the art. The coatings can range from lipstick and lip gloss used for cosmetic purposes, to lip balm and lip ointment used for medicinal purposes. The coatings can be applied using a stick applicator such as for lipstick, or can also be applied using a brush applicator using a jar or other lip coating container. One disadvantage of these application techniques is that much of the lip coating remains in the corners and crevices of the container and can therefore not be utilized.

BRIEF SUMMARY OF THE INVENTION

The present invention is directed to a device for applying lip coating and method of use. The device comprises a separate element from the lip coating container such as lipstick or lip gloss dispenser, jars of lip balm or ointment, and the like. It is used to remove lip coating from the lip coating container and apply the lip coating to the lip of a user. The device has a specially designed application end which can reach into the corners and crevices of the lip coating container to maximize the yield from the container. The device has an application end which has a smooth surface, and does not have a brush with bristles which can collect lip coating. This smooth feature facilitates cleaning the application end to remove the lip coating. In another embodiment, the device includes a cleaning device for cleaning the application end.

In accordance with an embodiment, a device for applying lip coating includes an applicator which has a handle which is connected to an application end by a shaft. The application end is smooth. A housing removably receives the shaft and the application end.

In accordance with another embodiment, the application end includes a frustoconical section which tapers downwardly away from the shaft.

In accordance with another embodiment, the application end includes a rounded tip.

In accordance with another embodiment, a cleaning device is disposed within the handle, the cleaning device for removing the lip coating from the application end. The handle has a cover. The cleaning device is accessible by removing the cover from the handle.

In accordance with another embodiment, the cleaning device includes a rod around which a roll of paper towels is disposed.

In accordance with another embodiment, a retainer is connected to the roll of paper towels, the retainer is provided for retaining the roll of paper towels in a rolled configuration.

In accordance with another embodiment, the housing includes a mirror.

Other embodiments, in addition to the embodiments enumerated above, will become apparent from the following detailed description, taken in conjunction with the accompanying drawings, which illustrate, by way of example, the principles of the device and method of use.

BRIEF DESCRIPTION OF THE DRAWINGS

FIG. 3 is an enlarged fragmented side elevation view of an application end and a shaft;

FIG. 4 is an end elevation view of the application end;

FIG. 5. is a perspective view of lip coating being placed on the application end;

FIG. 9 is a perspective view of one paper towel being removed from the roll; and, FIG. 10 is a perspective view of the paper towel being used to clean the application end.

DETAILED DESCRIPTION OF THE INVENTION

Figures 1, 2:
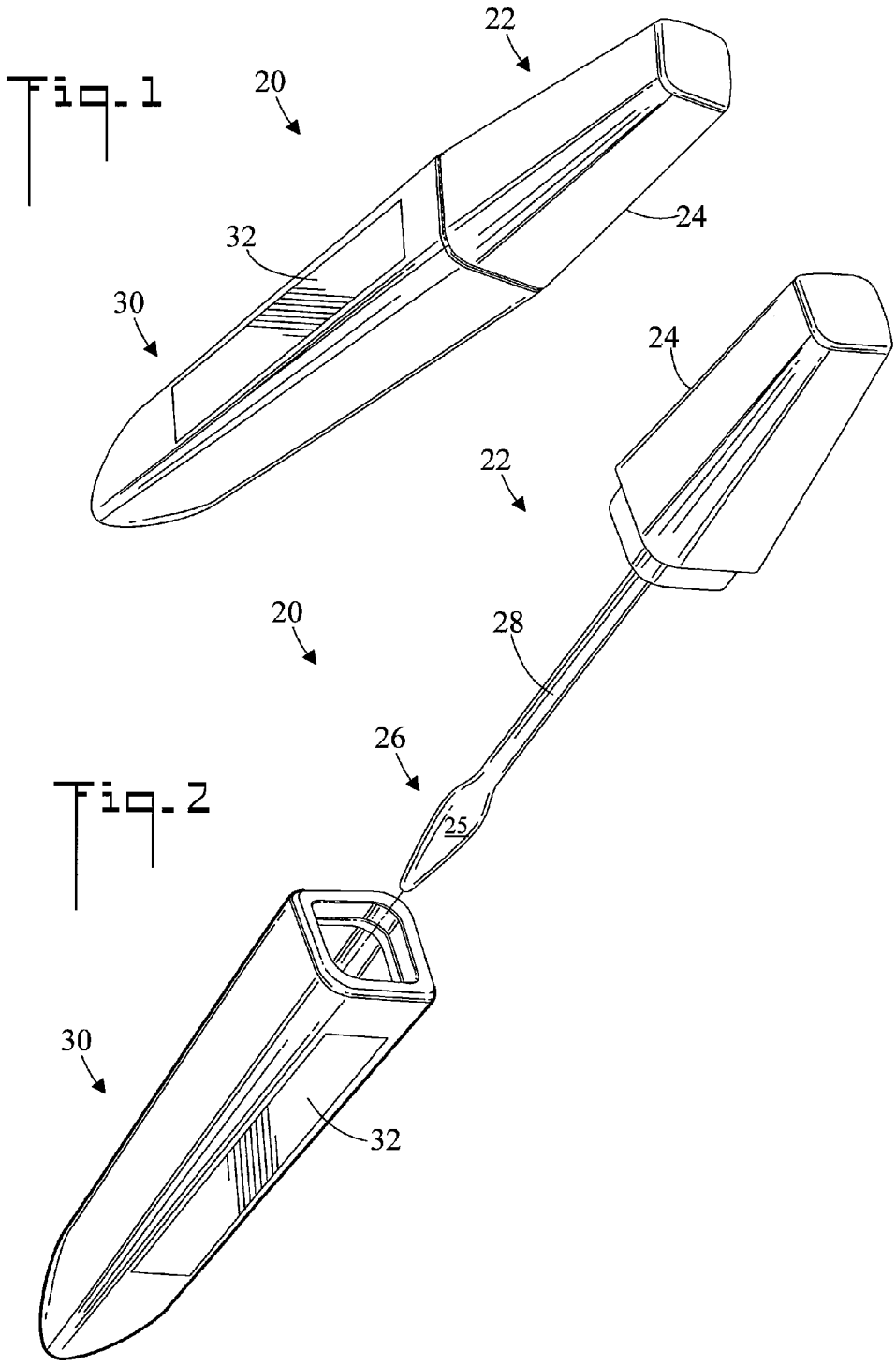
FIG. 1 is a perspective view of a device for applying lip coating in a closed position.
FIG. 2 is a perspective view of the device in an open position.

Referring initially to FIGS. 1 and 2, there are illustrated perspective views of a device for applying lip coating in closed position and open positions respectively, the device generally designated as 20. Device 20 includes an applicator 22 which has a handle 24 which is connected to an application end 26 by a shaft 28. Application end 26 (refer also to FIG. 3) is smooth. As used herein the term "smooth" means that the surface 25 of application end 26 is regular and free from perceptible projections and indentations. As such, lip coating 500 (refer to FIG. 5) can be wiped off of application end 26 without leaving appreciable lip coating residue. This allows application end 26 to be thoroughly cleaned when changing lip coatings 500 to prevent any possible cross-coating contamination. For example, if device 20 has been used to apply one color lipstick, it is desirable to remove all of that color before using device 20 to apply a different color lipstick. Device 20 further includes a housing 30 which removably receives shaft 28 and application end 26 when device 20 is in the closed not-in-use position of FIG. 1. In the shown embodiment device 20 further includes a mirror 32 which is useful when applying a lip coating 500.

FIG. 3 is an enlarged fragmented side elevation view of application end 26 and shaft 28, and FIG. 4 is an end elevation view of application end 26. In the shown embodiment, application end 26 includes a frustoconical section 34 which tapers downwardly away from shaft 28, and a rounded tip 36. Tapered downward away from shaft 28 means that frustoconical section 34 is larger near shaft 28 and smaller near rounded tip 36. Frustoconical section 34 is useful in applying lip coating 500 to the corner of the mouth, and rounded tip 36 is useful in applying lines of lip coating 500. In the shown embodiment there is a frustoconical transition 38 between application end 26 and shaft 28 which in can also be smooth.

FIG. 5. is a perspective view of lip coating 500 being placed on application end 26; In the shown embodiment, lip coating 500 from a nearly empty lipstick dispenser 600 is placed on application end 26 in preparation for application to a lip 700 (refer to FIG. 6). It is noted that because of the long narrow shape of application end 26 and shaft 28, lip coating 500 can be accessed in hard to reach corners and crevices of a lip coating container (such as a lipstick or lip gloss dispenser, cylindrical lip balm or lip ointment jars, etc.).

Figure 6:
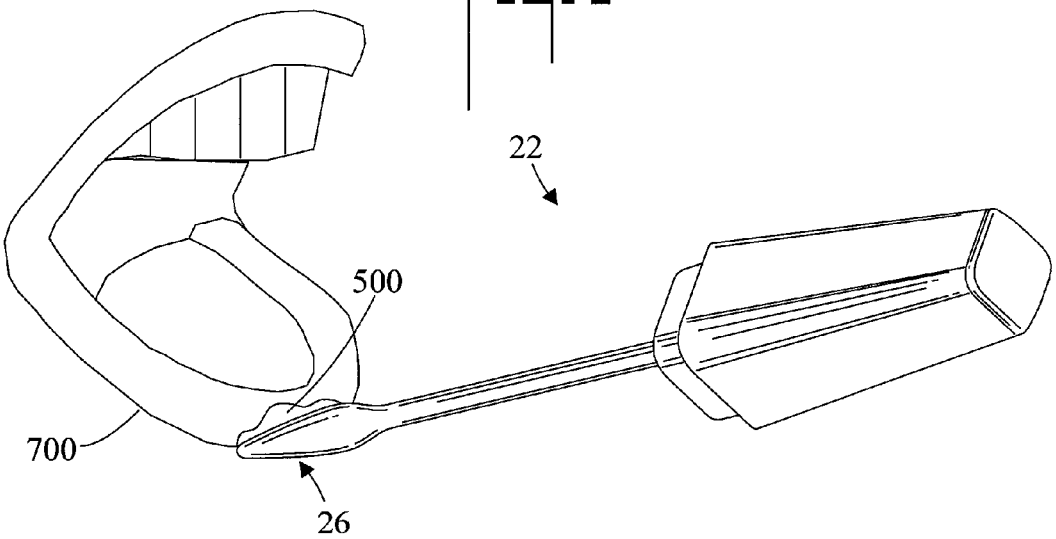
FIG. 6 is a perspective view of the device being used to apply lip coating to a lip.

FIG. 6 is a perspective view of device 20 being used to apply lip coating 500 to a lip 700. The lip coating 500 is first placed on application end 26 as shown in FIG. 5, and application end 26 is then used to apply lip coating 500 to lip 700.

Figure 7:
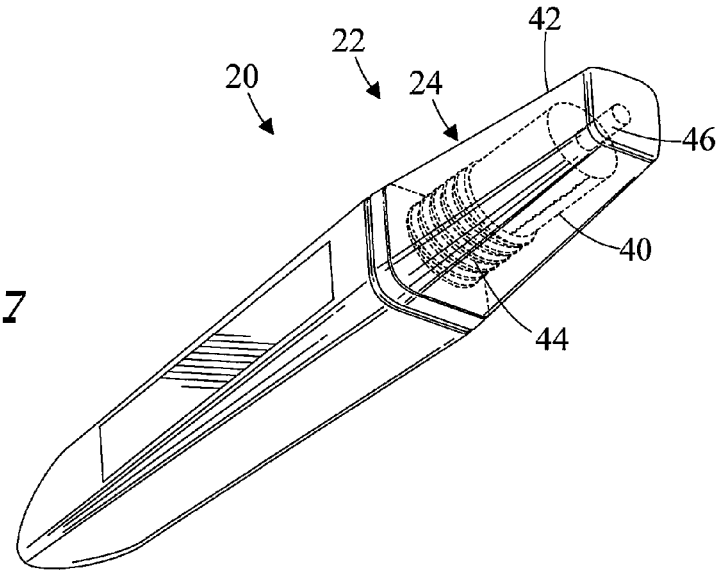
FIG. 7 is a perspective view of a second embodiment device which has a cleaning device disposed within the handle.
Figure 8:
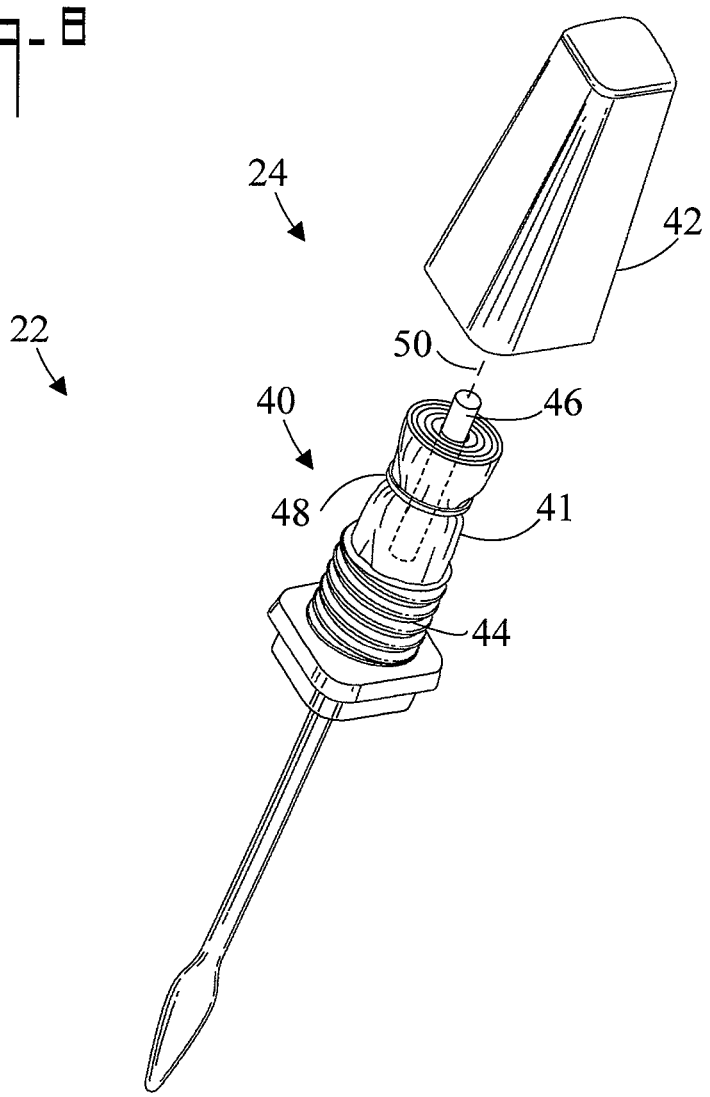
FIG. 8 is a perspective view of a roll of paper towels on a rod.

FIGS. 7 and 8 are perspective views of a second embodiment device 20 in the closed and open positions respectively, with a cleaning device 40 disposed within handle 24. Cleaning device 40 is for removing lip coating 500 from application end 26 (also refer to FIG. 10). In this embodiment handle 24 has a hollow cover 42 and a central axis 50. Cleaning device 40 is accessible by removing cover 42 from handle 24. The removal of cover 42 can be effected by a screw connection 44 as shown, or by other connection means such as a snap connector, etc. It is noted that when cover 42 is removed from handle 24, cover 42 is physically separated from handle 24.

In the shown embodiment, cleaning device 40 includes a rod 46 around which a small roll of paper towels 41 is disposed. Rod 46 is disposed along central axis 50 of handle 24. Similar to a conventional roll of paper towels, roll of paper towels 41 includes a plurality of individual paper towels which are connected by tear lines. The plurality of individual paper towels are rolled into a cylindrical configuration having a central hole which is shaped and dimensioned to accept rod 46. Roll of paper towels 41 is shaped and dimensioned to fit inside hollow cover 42. A retainer 48 is provided for retaining the roll of paper towels 41 in a rolled configuration. Retainer 48 can be the shown rubber band, or a string, a clip, a cap, or the like. It may be appreciated however, that other cleaning devices 40 are also possible. For example, cleaning device 40 could be a cleaning cloth or paper which is placed within hollow cover 42.

FIG. 9 is a perspective view of one paper towel 41A torn of from roll of paper towels 41. Roll of paper towels 41 has tear lines between individual towels as is well known in the art. It is noted that application end 26 is covered with lip coating 500. It is noted that when cover 42 is removed from handle 24, rod 46 and roll of paper towels 41 are exposed so that one paper towel 41A can be torn from roll of paper towels 41 by pulling paper towel 41A perpendicular to central axis 50 of handle 24.

FIG. 10 is a perspective view of paper towel 41A being used to clean application end 26 such as by wiping. The cleaning removes lip coating 500 from application end 26 in preparation for use with a different lip coating 500.

In terms of use, a method for applying lip coating 500 to a lip 700 includes; (refer to FIGS. 1-10)

(a) providing lip coating 500;

(b) providing a device 20 for applying the lip coating 500, including;

an applicator 22, the applicator 22 including a handle 24 which is connected to an application end 26 by a shaft 28;

the application end 26 being smooth;

a housing 30 which removably receives the shaft 28 and the application end 26;

(c) placing the lip coating 500 on the application end 26; and, (d) applying the lip coating 500 to the lip 700.

The method of further including:

in (b), the device 20 further including:

a cleaning device 40 disposed within the handle 24, the cleaning device 40 for removing the lip coating 500 from the application end 36;

the handle 24 having a cover 42;

the cleaning device 40 being accessible by removing the cover 42 from the handle 24; and, after (d), removing the cover 42 from the handle 24, and using the cleaning device 40 to remove the lip coating 500 from the application end 26.

The method further including:

in (b), the cleaning device 40 including a rod 46 around which a roll of paper towels 41 is disposed; and, using the cleaning device 40 to remove the lip coating 500 from the application end 26 including tearing off a paper towel 41A from the roll of paper towels 41 to effect the cleaning.

The method further including:

in (b), providing a retainer 48 connected to the roll of paper towels, the retainer 48 for retaining the roll of paper towels 41 in a rolled configuration; and, removing the retainer 48 before tearing off the paper towel 41A from the roll of paper towels 41.

The embodiments of the device and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the device and method should be construed as limiting the invention to a particular embodiment or combination of embodiments. The scope of the invention is defined by the appended claims.

We claim:

1. A method for applying lip coating to a lip, comprising:

(a) providing lip coating;

(b) providing a device for applying said lip coating, including;

an applicator which has a handle which is connected to an application end by a shaft;

a housing which removably receives said shaft and said application end;

a cleaning device disposed within said handle, said cleaning device for removing said lip coating from said application end;

said handle having a cover and a central axis;

said cleaning device being accessible by removing said cover from said handle;

said cleaning device including a rod around which a roll of paper towels is disposed, said rod disposed along said central axis of said handle;

when said cover is removed from said handle, said rod and said roll of paper towels are exposed so that one paper towel can be torn from said roll of paper towels by pulling said paper towel perpendicular to said central axis of said handle;

when said cover is removed from said handle, said cover is physically separated from said handle;

a retainer connected to said roll of paper towels, said retainer for retaining said roll of paper towels in a rolled configuration;

said retainer being a rubber band;

(c) placing said lip coating on said application end;

(d) applying said lip coating to the lip;

(e) after (d), removing said cover from said handle by physically separating said cover from said handle;

(f) removing said rubber band from said roll of paper towels;

(g) tearing one paper towel from said roll of paper towels by pulling said paper towel perpendicular to said central axis of said handle; and, (h) using said paper towel to remove said lip coating from said application end.

* * * * *